US005688192A

United States Patent [19]

Aoyama

[11] Patent Number: 5,688,192

[45] Date of Patent: Nov. 18, 1997

[54] SOLID CONSTRUCTION GOLF BALL INCORPORATING COMPRESSIBLE MATERIALS

[75] Inventor: Steven Aoyama, Marion, Mass.

[73] Assignee: Acushnet Company, Fairhaven, Mass.

[21] Appl. No.: 482,518

[22] Filed: Jun. 7, 1995

[51] Int. Cl.[6] ..... A63B 37/06

[52] U.S. Cl. ..... 473/374; 473/369; 473/370; 473/377

[58] Field of Search ..... 273/230, 231, 273/60 R; 473/371, 377, 372, 373, 374, 375, 376, 352, 355, 256

[56] References Cited

U.S. PATENT DOCUMENTS

| | | | |
|---|---|---|---|
| 719,500 | 2/1903 | Painter | 273/230 X |
| 3,238,156 | 3/1966 | Kohrn | 473/371 |
| 3,239,228 | 3/1966 | Crompton | 473/371 X |
| 3,940,145 | 2/1976 | Gentiluomo | 473/371 X |
| 4,026,561 | 5/1977 | Baldorossi et al. | 473/256 |
| 4,085,937 | 4/1978 | Schenk | 273/235 R X |
| 4,274,637 | 6/1981 | Molitor | 273/235 R |
| 4,431,193 | 2/1984 | Nesbitt | 273/235 R |
| 4,650,193 | 3/1987 | Molitor et al. | 273/228 |
| 4,674,170 | 6/1987 | Hubbert et al. | 29/458 |
| 4,674,751 | 6/1987 | Molitor et al. | 273/235 R |
| 4,805,914 | 2/1989 | Toland | 273/231 |
| 4,836,552 | 6/1989 | Puckett et al. | 273/218 |
| 4,839,116 | 6/1989 | Puckett et al. | 273/60 R X |
| 4,848,770 | 7/1989 | Shama | 273/228 |
| 4,863,167 | 9/1989 | Matsuki et al. | 273/230 X |
| 5,150,906 | 9/1992 | Molitor et al. | 273/220 |
| 5,482,285 | 1/1996 | Yabuki et al. | 473/373 |

*Primary Examiner*—George J. Marlo
*Attorney, Agent, or Firm*—Pennie & Edmonds LLP

[57] ABSTRACT

The subject invention relates to a golf ball having the beneficial characteristics of both a wound and solid construction ball. The invention is directed to a non-wound golf ball incorporating a compressible material, such as a gas, as part of its core. The compressible material can be dispersed throughout the entire core or only in a part of the core. The compressible material or gas can be incorporated into the core by including or dispersing microspheres having a flexible shell containing the compressible material or gas. The golf balls of this invention combine the feel and playing characteristics of a wound construction ball with the shelf-life, manufacturing simplicity and durability of solid construction golf balls.

12 Claims, 1 Drawing Sheet

SOLID CONSTRUCTION GOLF BALL INCORPORATING COMPRESSIBLE MATERIALS

BACKGROUND OF THE INVENTION

Present day golf balls can be classified under one of two categories: solid balls and wound balls. The first category of solid balls includes unitary or one-piece golf balls as well as multi-piece balls. One-piece golf balls, seldomly used as playing balls, are typically made from a solid piece of polybutadiene rubber, with dimples molded into its surface. Although inexpensive and durable, these unitary balls are generally limited to use as practice balls because they do not give the desired distance when hit. In contrast, multi-piece solid balls usually consist of a core of hard, polymeric materials enclosed in a distinct, cut-proof cover made of DuPont's SURLYN, an ionomer resin. Because of its durability and low spin, which produces greater distance and reduced hooking and slicing, this type of ball is the most popular among ordinary players.

Wound golf balls are manufactured by wrapping elastic windings under high tension around a solid rubber or liquid filled center. A cover, usually SURLYN or balata is molded over the windings to form the ball. This winding process naturally incorporates a certain amount of trapped air within the layer of windings. The air trapped within a wound construction ball provides certain characteristics which are considered by many golfers to be desirable. It creates a soft feel at impact due to its compressible nature and high resiliency due to its high efficiency (low damping) as a spring. For skilled golfers, these wound balls typically provide a higher spin rate and offer more control over the ball's flight than solid balls.

Unfortunately, the wound construction is also more difficult and expensive to manufacture than solid construction golf balls. Also, wound golf balls have comparatively shorter shelf life and lower resistance to certain types of damage than solid balls.

Various attempts have been made to mimic these wound construction benefits using solid construction manufacturing techniques. However, these balls generally have used softer core materials, softer cover materials, layers of soft materials combined with conventional materials or combinations thereof. Examples of such balls include the Titleist HP2, Pinnacle Performance, Ultra Competition, Ultra Tour Balata, Maxfli HT Hi Spin, Precept EV Extra Spin, Altus Newing, Top-Flite Tour Z-Balata, Top-Flite Tour and Kasco's "Dual Core" balls. Likewise U.S. Pat. No. 4,650,193 to Molitor also discloses a golf ball made from relatively "soft" materials. While these solid constructions sometimes produce improved feel or playing characteristics which simulate those of wound balls, they fail to completely capture the same desired characteristics. In addition, the soft materials often produce compromised resilience or durability or both.

This invention takes a different approach. Instead of using soft but incompressible materials, it employs compressible materials such as gases in the core of a solid construction golf ball. This approach provides a much better simulation of the effects of the trapped air in a wound construction golf ball while using a manufacturing process similar to that for solid golf balls. The result is a ball having the soft feel and high resilience of wound construction balls combined with the manufacturing simplicity, shelf life and durability of solid construction balls.

Although prior art golf balls have employed such a gaseous component, these balls have been typically special purpose balls or balls where only the covers incorporate such a material as disclosed in U.S. Pat. Nos. 5,150,906 and 4,274,637 to Molitor et al. and U.S. Pat. No. 4,431,193 to Nesbitt. Representative of special purpose balls are short-distance balls such as those disclosed in U.S. Pat. No. 4,836,552 to Puckett et al., floater balls such as those described in U.S. Pat. No. 4,085,937 to Schenk and "Nerf" type toy and practice balls. These balls incorporate gas in the ball materials for the purposes of reducing the ball's weight and/or its potential for causing damage to a struck object. They do not feel or perform in any way like a normal wound or solid construction golf ball.

SUMMARY OF THE INVENTION

This invention relates to multi-piece golf balls and their method of manufacture. In particular, this invention is directed towards golf balls comprising a core of a material incorporating a compressible gaseous material or cellular material, and a spherical cover or shell of polymeric material.

In addition this invention provides a solid construction golf ball having the beneficial characteristics of both wound and solid construction type balls. The golf balls of this invention combine the feel and playing characteristics of a wound construction with the shelf life and durability of a solid construction golf ball.

Furthermore, the golf balls of this invention will have advantages over both conventional solid as well as wound construction balls in cold weather. Under such conditions, solid construction balls develop a very hard feel due to the stiffening of the materials. They do, however, retain most of their resilience so they do not lose much distance. On the other hand, wound construction balls retain much of their soft feel (because the entrapped air does not stiffen significantly), but they lose distance due to a loss of resilience in the high tension windings. A ball made according to this invention will retain softness like a wound ball, and retain resilience like a solid construction ball.

Another objective of this invention to provide a golf ball having the desired characteristics of a wound construction ball and the manufacturing simplicity and cost-savings of a solid construction ball.

This invention is further directed towards the manufacture of a solid construction golf ball possessing the performance characteristics of a wound ball and benefits of solid construction balls.

A DETAILED DESCRIPTION OF THE PREFERRED EMBODIMENTS

The key to this invention is that compressible materials are incorporated into the construction of the golf ball. "Compressible materials" are materials whose density is strongly affected by pressure or temperature. Gases would generally be considered to be compressible materials while liquids and solids would not be.

As defined in this invention the word "core" refers to unitary cores as well as multi-layered cores. The compressible materials of this invention can be incorporated into the entire core or into at least one layer of the core. Preferably the compressible gaseous material is incorporated into the outer layer of a multi-layered core so that the golf ball behaves and plays more like a wound ball. The thickness of the layer containing the Compressible material preferably ranges from about 0.05 inches to 0.80 inches, which is generally the diameter of the entire core. More preferably, the thickness of such layer ranges from about 0.10 to 0.25 inches.

Figure 1:
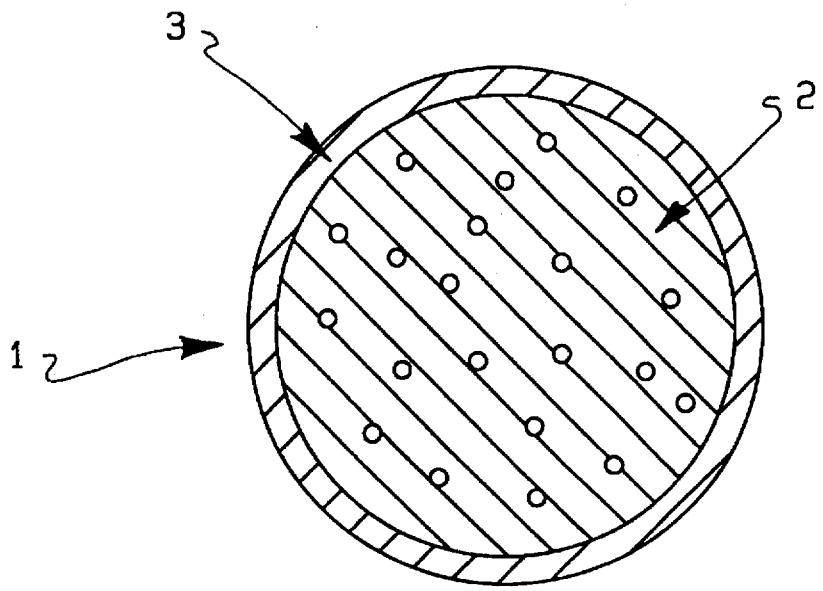
FIG. 1 is a cross-sectional view of a golf ball of this invention where the solid core is made of a material incorporating a compressible gaseous material.
Figure 2:
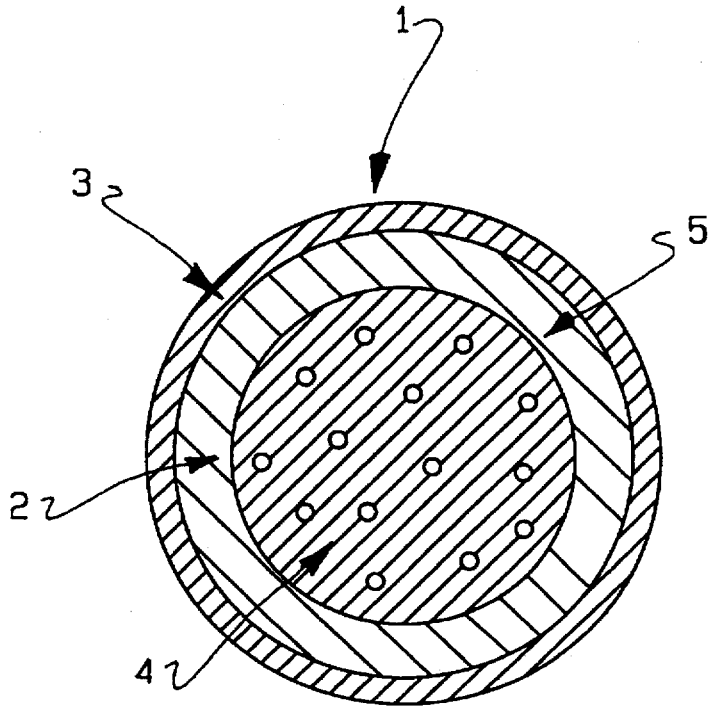
FIG. 2 is a cross-sectional view of a golf ball of this invention where the outer layer of the core is made of a cellular material or a material incorporating a compressible gaseous material.

The figures exemplify two embodiments of this invention. These figures are provided to further the understanding of this invention and are not to be construed as limiting the claims in any manner. FIG. 1 illustrates a golf ball 1 which includes the compressible material in the entire core 2. To complete the ball, a cover 3 is molded over the core 2. In FIG. 2, the ball 1 comprises a multiple layered core 2 comprising an inner core layer 4 and an outer core layer 5. The compressible material is incorporated into the outer core layer 5.

Suitable core materials into which the compressible gaseous material can be incorporated include solids and liquids. In general, the core material will essentially be incompressible. Among these materials is polybutadiene, a polymer which is presently used to make cores for nearly all commercial golf balls. Also, various thermoplastic materials such as DuPont's SURLYN, an ionomer resin, DuPont's Hytrel, or B.F. Goodrich's Estane, or blends thereof, could be used. Furthermore, materials which are not normally resilient enough for use in golf ball cores but may be satisfactory when the compressible gaseous material is incorporated into it may be used. One such example is polyurethane.

The proportions of compressible gaseous material to core material that are suitable will depend upon the core materials used as well as the performance characteristic or effects that are desired of the golf ball. In general, a range of about 5% to 50% compressible material by volume of the core layer containing the compressible material is suitable. For outer core layers which have thicknesses equivalent to that of the winding layer in wound balls, 10–15% compressible material by volume of the outer core layer is preferred. However, for thinner layers or layers made of stiffer materials, a higher proportion of compressible material to core material is recommended. Preferably, the compressible material is distributed uniformly in the core layer or entire core.

The gaseous materials can be incorporated into the core polymer in a number of ways. The core polymeric materials can be "foamed" by various techniques which include, but are not limited to the use of blowing agents, gas injection, mechanical aeration and two-component reactive systems. U.S. Pat. No. 4,274,637 to Molitor describes the use of blowing agents and gas injection to foam polymeric materials. Blowing agents foam the core polymeric materials by decomposing to form gases which are absorbed by the materials. The gas then expands to form the foamed core materials or cellular core material. Foaming by gas injection can be achieved by injecting a gas under pressure such as nitrogen, air, carbon dioxide, etc. into the material. When the gas expands, the material is foamed.

In addition, the gas can be added to the core material by the inclusion of gases encapsulated in microspheres. This addition can be done by mixing gas-filled microspheres into the polymer composition. However, the encapsulating envelope of such gas must be of a material flexible enough to permit compression of the gas inside during impact. Such encapsulating materials include polymeric microspheres, such as acrylonitrile copolymer microspheres, as well as expandable microspheres. However, glass microspheres would not be appropriate for this invention because of their rigidity.

Regardless of the materials from which they are made appropriate microspheres must be of a size such that they be small enough to act like a continuous medium when incorporated into the core material. Typically a microsphere diameter on the order of at most 10% of the thickness of the core layer incorporating the compressible material is suitable.

Moreover, various crosslinkers and fillers can be added to the core materials along with the gaseous material. Suitable cross-linking agents include metallic salts of an unsaturated carboxylic acid. These salts are generally zinc diacrylate or zinc dimethacrylate. Of these two crosslinkers, zinc diacrylate has been found to produce golf balls with greater initial velocity than zinc dimethacrylate.

Suitable fillers that can be used in this invention include free radical initiators used to promote crosslinking of the salt and the polybutadiene. The free radical initiator is suitably a peroxide compound such as dicumyl peroxide, 1,1-di (T-butylperoxy) 3,3,5-trimethyl cyclohexane, a—a bis (T-butylperoxy) diisopropylbenzene, 2,5-dimethyl-2,5 di (T-butylperoxy) hexane, or di-T-butyl peroxide, and mixtures thereof. Also other substantially inert fillers such as zinc oxide, barium sulfate and limestone as well as additives can be added to the mixture. The maximum amount of fillers utilized in a composition is governed by the specific gravity of the fillers as well as the maximum weight requirement established by the U.S.G.A. Appropriate fillers generally used range in specific gravity from 2.0–5.6.

There are generally two basic techniques used in the manufacture of golf balls: Compression molding and injection molding. Both these techniques are well-known in the art. For an inventive ball having the compressible material dispersed throughout the core, the gas is incorporated by adding the microspheres or by some other foaming technique into polybutadiene or some other suitable core material. After the addition of the compressible materials, the core material composition is then extruded into preforms suitable for molding. The preforms are then compression molded into spherical cores. The cover, typically of a thermoplastic material, is then either injection molded directly around the core or compression molded using pre-formed hemispheres of cover material placed around the core. Such cover materials, such as SURLYN or balata rubber, are known in the art.

For an inventive ball where the compressible material is incorporated into the outer layer of the core, the center of the core would be formed by compression molding a core material to form a sphere with a diameter less than that of the finished core. The outer layer of the core which incorporates the compressible material is then either injection molded or compression molded around the center of the core. Finally, the cover would be injection molded or compression molded around the core by conventional means.

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments as falling within the true spirit and scope of the present invention.

I claim:

1. A finished regulation long range, solid construction, multi-piece golf ball comprising a discrete cover and a core, said core comprising an inner and an outer portion, said inner portion having a plurality of gas containing compressible cells dispersed therein.

2. The golf ball of claim 1 wherein said cells comprise about 5% to 50% by volume of the entire core.

3. The golf ball of claim 2 wherein said cells comprise about 10% to 15% by volume of the entire core.

4. The golf ball of claim 1 wherein said cells are dispersed throughout substantially the entire core.

5. The golf ball of claim 4 wherein said cells comprise a plurality of microspheres having a flexible outer surface.

6. The golf ball of claim 5 wherein said surface is formed from a polymer.

7. The golf ball of claim 6 wherein said polymer is an acrylonitrile copolymer.

8. The golf ball of claim 5 wherein each said microsphere has a diameter of about ≦10% of that of the entire core.

9. A finished regulation long range, solid construction, multi-piece golf ball comprising a discrete cover and layered core, said core comprising an outer layer and an inner layer, said inner layer having a plurality of gas containing compressible cells dispersed therein.

10. The golf ball of claim 9 wherein said cells comprise a plurality of microspheres having a flexible outer surface.

11. The golf ball of claim 9 wherein said cells are dispersed in a layer within said core inner layer having a thickness of about 0.05–0.80 inches.

12. The golf ball of claim 9 wherein said cells are dispersed in a layer within said core inner layer having a thickness of about 0.10–0.25 inches.

* * * * *

UNITED STATES PATENT AND TRADEMARK OFFICE
CERTIFICATE OF CORRECTION

PATENT NO. : 5,688,192

DATED : November 18, 1997

INVENTOR : Steven Aoyama

It is certified that errors appear in the above-identified patent and that said Letters Patent is hereby corrected as shown below:

In column 2, line 54, "outer" has been replaced with --inner--.

In column 3, line 19, "outer" has been replaced with --inner--.

In column 3, line 20, "5" has been replaced with --4--.

Signed and Sealed this

Sixteenth Day of June, 1998

*Attest:*

*Attesting Officer*

BRUCE LEHMAN

*Commissioner of Patents and Trademarks*